US008259033B2

(12) United States Patent
Taylor et al.

(10) Patent No.: US 8,259,033 B2
(45) Date of Patent: Sep. 4, 2012

(54) FURLABLE SHAPE-MEMORY SPACECRAFT REFLECTOR WITH OFFSET FEED AND A METHOD FOR PACKAGING AND MANAGING THE DEPLOYMENT OF SAME

(75) Inventors: Robert Taylor, Superior, CO (US); Rory Barrett, Lafayette, CO (US); Will Francis, Lyons, CO (US); Dana Turse, Broomfield, CO (US); Phil Keller, Longmont, CO (US); Larry Adams, Arvada, CO (US)

(73) Assignee: Composite Technology Development, Inc., Lafayette, CO (US)

( * ) Notice: Subject to any disclaimer, the term of this patent is extended or adjusted under 35 U.S.C. 154(b) by 538 days.

(21) Appl. No.: 12/361,700

(22) Filed: Jan. 29, 2009

(65) Prior Publication Data

US 2010/0188311 A1 Jul. 29, 2010

(51) Int. Cl.
*H01Q 15/20* (2006.01)

(52) U.S. Cl. ..... 343/915; 343/914; 29/600

(58) Field of Classification Search ..... 343/915, 343/897, 840, 912; 428/298.1; 264/321
See application file for complete search history.

(56) References Cited

U.S. PATENT DOCUMENTS

| | | | | |
|---|---|---|---|---|
| 4,030,103 | A | | 6/1977 | Campbell |
| 4,646,102 | A | | 2/1987 | Akaeda et al. |
| 4,926,181 | A | | 5/1990 | Stumm |
| 5,488,383 | A | | 1/1996 | Friedman et al. |
| 5,574,472 | A | | 11/1996 | Robinson |
| 5,644,322 | A | * | 7/1997 | Hayes et al. ..... 343/915 |
| 5,680,145 | A | | 10/1997 | Thomson et al. |
| 5,700,337 | A | | 12/1997 | Jacobs et al. |
| 5,787,671 | A | | 8/1998 | Meguro et al. |
| 5,864,324 | A | | 1/1999 | Acker et al. |
| 5,968,641 | A | * | 10/1999 | Lewis ..... 428/298.1 |
| 5,990,851 | A | | 11/1999 | Henderson et al. |
| 6,104,358 | A | | 8/2000 | Parker et al. |
| 6,137,454 | A | | 10/2000 | Peck |

(Continued)

FOREIGN PATENT DOCUMENTS

WO WO 03/018853 A2 3/2003

OTHER PUBLICATIONS

Barrett, Rory et al., "Deployable Reflectors for Small Satellites," 21st Annual Conference on Small Satellites, 2007, pp. 109.*

(Continued)

*Primary Examiner* — Jacob Y Choi
*Assistant Examiner* — Amal Patel
(74) *Attorney, Agent, or Firm* — Kilpatrick Townsend & Stockton LLP

(57) ABSTRACT

A shape-memory reflector is provided according to various embodiments. The shape-memory reflector may comprise any of various shapes; for example, the shape-memory reflector may comprise an off-axis paraboloid or a non-asymmetric shape. The shape-memory reflector may include a plurality of panel shape-memory stiffeners and a plurality of longitudinal stiffeners. In a stowed configuration, the shape-memory reflector is stowed with reversing bends in the panel shape-memory stiffeners. In a deployed state, the panel shape-memory stiffeners may be unfolded and/or extended. The reflector transitions between the stowed and deployed states by heating the panel shape-memory stiffeners. Various methods for stowing and deploying the shape-memory reflector are also disclosed.

27 Claims, 9 Drawing Sheets

U.S. PATENT DOCUMENTS

| | | | | |
|---|---|---|---|---|
| 6,208,317 | B1 | 3/2001 | Taylor et al. | |
| 6,225,965 | B1 | 5/2001 | Gilger et al. | |
| 6,243,053 | B1 | 6/2001 | Shtarkman | |
| 6,278,416 | B1 | 8/2001 | Harless | |
| 6,313,811 | B1 | 11/2001 | Harless | |
| 6,344,835 | B1 * | 2/2002 | Allen et al. | 343/915 |
| 6,373,449 | B1 | 4/2002 | Bokulic et al. | |
| 6,384,800 | B1 | 5/2002 | Bassily et al. | |
| 6,441,801 | B1 | 8/2002 | Knight et al. | |
| 6,542,132 | B2 | 4/2003 | Stern | |
| 6,618,025 | B2 | 9/2003 | Harless | |
| 6,624,796 | B1 * | 9/2003 | Talley et al. | 343/915 |
| 6,702,976 | B2 * | 3/2004 | Sokolowski | 264/321 |
| 6,828,949 | B2 | 12/2004 | Harless | |
| 6,930,654 | B2 | 8/2005 | Schmid et al. | |
| 7,098,867 | B1 * | 8/2006 | Gullapalli | 343/915 |
| 7,429,074 | B2 | 9/2008 | McNight et al. | |
| 7,710,348 | B2 * | 5/2010 | Taylor et al. | 343/915 |
| 2003/0122723 | A1 * | 7/2003 | Luly et al. | 343/781 P |
| 2008/0006353 | A1 | 1/2008 | Elzey et al. | |

OTHER PUBLICATIONS

PCT International Search Report and Written Opinion mailed Mar. 23, 2010; International Application No. PCT/US2010/022372; 8 pages.

PCT International Search Report and Written Opinion mailed Apr. 17, 2009; International Application No. PCT/US09/34397, 7 pages.

Lin, John K. et al., "Shape Memory Rigidizable Inflatable (RI) Structures for Large Space Systems Applications," AIAA Paper No. 2006-1896, pp. 7-8. May 1-4, 2006.

Tan, L. et al., "Stiffening Method for Spring-Back Reflectors," Computational Methods for Shell and Spatial Structures, IASS-IACM 2000.

Abrahamson, Erik R. et al., "Shape Memory Mechanics of an Elastic Memory Composite Resin," Journal of Intelligent Material Systems and Structures, vol. 14, pp. 623-632, Oct. 2003.

Sokolowski, Witold M. et al., "Lightweight Shape Memory Self-Deployable Structures for Gossamer Applications," 45th AIAA/ASME/ASCE/AHS/ASC Structures, Structural Dynamics & Materials Conference, 10 pages, Apr. 19-22, 2004.

* cited by examiner

FURLABLE SHAPE-MEMORY SPACECRAFT REFLECTOR WITH OFFSET FEED AND A METHOD FOR PACKAGING AND MANAGING THE DEPLOYMENT OF SAME

BACKGROUND

This disclosure relates in general to deployable antenna reflectors and, but not by way of limitation, to deployable reflectors utilizing shape-memory polymers among other things.

Antennas are designed to concentrate RF energy being broadcast or received into a directional beam to reduce the power required to transmit the signal. A reflective antenna uses one or more large surfaces, or reflectors, to reflect and focus the beam onto a feed. Spacecraft often employ large reflectors that must be reduced in size for launch and which are deployed on orbit. A deployable antenna reflector should be light weight, have a small stowage-to-deployment volumetric ratio, provide an efficient reflective surface, and be as simple as possible to deploy.

BRIEF SUMMARY

A shape-memory deployable reflector is disclosed according to one embodiment. The shape-memory reflector may be configured to maintain both a first stowed configuration and a second deployed configuration. The shape-memory reflector may include a reflective surface, a plurality of linear stiffeners (longitudinal stiffeners) and a plurality of shape-memory stiffeners (panel shape-memory stiffeners). Both the linear stiffeners and the shape-memory stiffeners are coupled with the reflective surface. In the deployed configuration the plurality of shape-memory elements are unpleated and the reflector surface may define a doubly curved three dimensional geometry. In the stowed configuration the plurality of shape-memory stiffeners may be pleated into a first plurality of pleats and the reflector surface is pleated into a second plurality of pleats. The shape-memory reflector may be configured to deploy into the deployed configuration by heating one or more of the shape-memory stiffeners to a temperature greater than a glass transition temperature of the shape-memory stiffeners.

In some embodiments, the deployed three dimensional geometry of the reflector surface may comprise a non-axially symmetric geometry or an off-axis paraboloid. The paraboloid surface may be modified by local contouring to distribute the beam of the antenna into some desired shape other than circular. In some embodiments, at least a subset of the plurality of shape-memory stiffeners are arranged substantially parallel to one another. In some embodiments, at least a subset of the plurality of linear stiffeners are arranged substantially parallel to one another. In some embodiments, at least a subset of the plurality of linear stiffeners are arranged perpendicular to at least a subset of the plurality of shape-memory stiffeners. The reflector surface, for example, may include a graphite composite laminate. The shape-memory stiffener, for example, may comprise a shape-memory polymer having a glass transition temperature that is less than a survival temperature of the shape-memory polymer.

In some embodiments, the shape-memory stiffeners may comprise a composite panel including a first face sheet of elastic material, a second face sheet of elastic material, and a shape-memory polymer core sandwiched between the first face sheet and the second face sheet, wherein the first face sheet includes a portion of the reflector surface. The plurality of linear stiffeners, for example, may comprise a laminate material and/or a solid material, wherein one face of the stiffener may include a portion of the reflector surface. The shape-memory reflector, for example, may include one or more heaters coupled with the shape-memory stiffener.

A method for stowing a shape-memory reflector is provided according to another embodiment. The method may include fabricating the shape-memory reflector in a deployed configuration. The shape-memory reflector may include a reflector surface, a plurality of linear stiffeners coupled with the reflector surface, and a plurality of shape-memory stiffeners coupled with the reflector surface. The plurality of shape-memory stiffeners may be heated to a temperature above the glass transition temperature of the shape-memory stiffeners and mechanical loads may be applied to deform the shape-memory reflector into a stowed configuration. The shape-memory stiffeners may then be cooled to a temperature below the glass transition temperature of the shape-memory stiffeners and the mechanical loads may be removed, allowing the cooled shape-memory stiffeners to maintain the stowed configuration.

A method for deploying a shape-memory reflector from a stowed configuration is provided according to another embodiment. The shape-memory reflector includes a reflector surface, a plurality of linear stiffeners coupled with the reflector surface, and a plurality of shape-memory stiffeners coupled with the reflector surface. In the stowed configuration, the plurality of shape-memory elements are pleated into a plurality of pleats and the reflector surface is pleated into a plurality of pleats. The plurality of shape-memory stiffeners may be heated to a temperature above the glass transition temperature of the shape-memory stiffeners. The shape-memory stiffeners may then be allowed to transition from a pleated configuration to a non-pleated configuration. The plurality of shape-memory stiffeners may then be cooled to a temperature below the glass transition temperature of the shape-memory stiffeners.

Further areas of applicability of the present disclosure will become apparent from the detailed description provided hereinafter. It should be understood that the detailed description and specific examples, while indicating various embodiments, are intended for purposes of illustration only and do not limit the scope of the disclosure.

Figure 1:
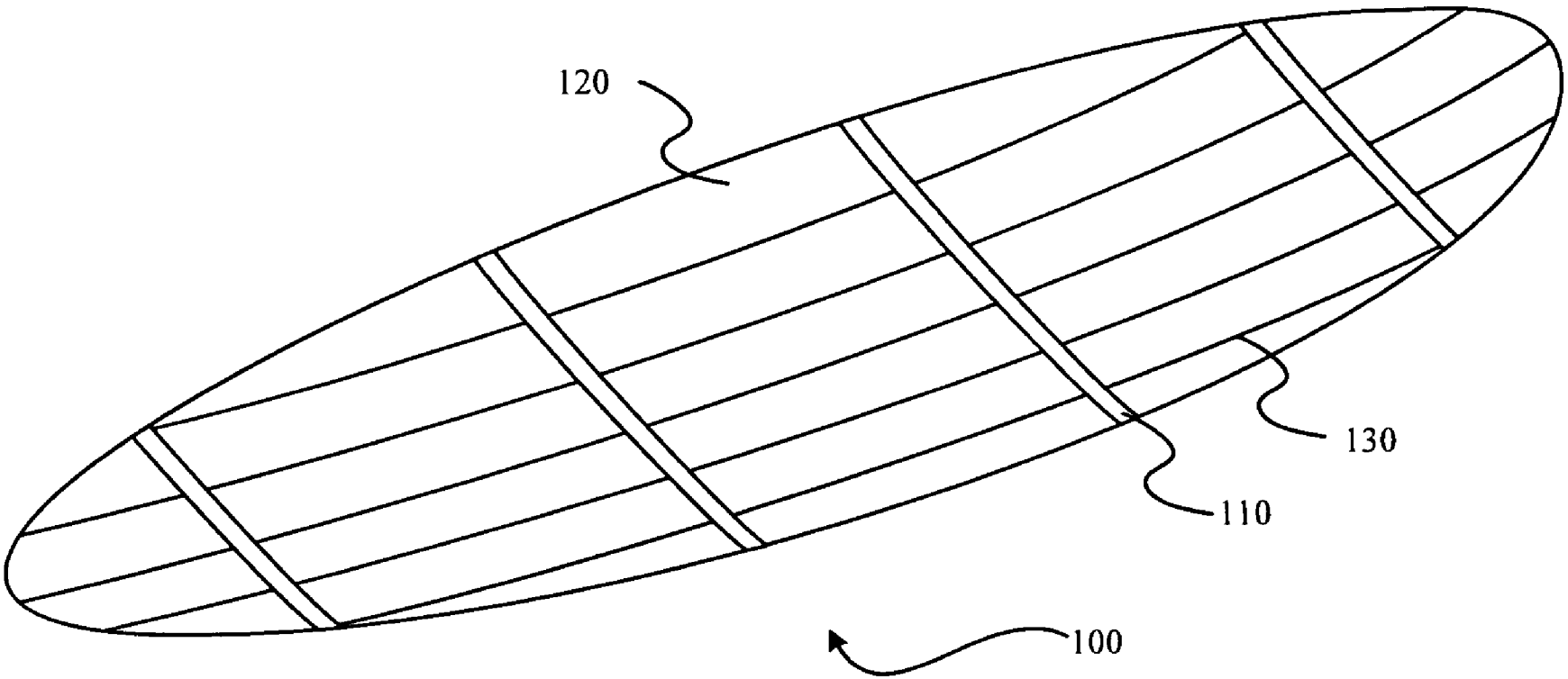
FIG. 1 shows a furlable shape-memory reflector in a deployed configuration according to one embodiment.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The ensuing description provides various embodiments of the invention only, and is not intended to limit the scope, applicability or configuration of the disclosure. Rather, the ensuing description of the embodiments will provide those skilled in the art with an enabling description for implementing an embodiment. It should be understood that various changes may be made in the function and arrangement of elements without departing from the spirit and scope as set forth in the appended claims.

Embodiments of the present disclosure are directed toward shape-memory reflectors. Such shape-memory reflectors may be adapted for space communication applications. The shape-memory reflector may be prepared and launched in a packaged (or stowed or furled) configuration that maintains the packaged shape, reducing the number of mechanical devices required to secure the reflector during launch. Once in space, the shape-memory reflector may be deployed with few or no moving parts. For example, the shape-memory reflector may be in an offset fed shape, a parabolic shape or an irregular shape in a deployed configuration and stowed in a furled and/or folded configuration. The shape-memory reflector may include a surface of substantially continuous, elastic reflector material. For example, the elastic reflector material may comprise a laminate of composite polymer layers.

The shape-memory reflector may include a shape-memory stiffener that is used to actuate the reflector from the packaged configuration to the deployed configuration when heated above $T_g$. The shape-memory stiffener may include a sandwich of flexible face sheets around a core of shape-memory material, for example, a shape-memory polymer and/or foam. One of the flexible face sheets may include the reflector material. The shape-memory stiffener may be attached circumferentially on the reflector material. In one embodiment, the panel shape-memory stiffeners may be attached along a surface of the reflector material. In another embodiment, the shape-memory stiffener may be attached circumferentially with various other circumferences of the reflector material with a radius less than or equal to the radius of the paraboloid.

In various embodiments, the shape-memory reflector may also include a plurality of longitudinal stiffeners that are, for example, longitudinally attached with the back surface of the reflector material. In some embodiments, the longitudinal stiffeners may extend along the reflector material substantially perpendicularly to the panel shape-memory stiffeners.

FIG. 1 shows a shape-memory reflector 100 in a deployed configuration according to one embodiment. Shape-memory reflector 100, in some embodiments, may be deployed in a non-asymmetric shape, such as an off-axis paraboloid. In other embodiments, the shape-memory reflector 100 may be deployed in any shape, including irregular shapes. The shape-memory reflector 100 includes a substantially continuous reflector material 120. The reflector material 120 may include a graphite-composite laminate with between one and six plies. Various other materials such as thin metallic membranes, epoxy films, or other laminates may be used. The laminates may include various thicknesses. The reflector material 120 may be formed on a parabolic mandrel during manufacture. The reflector material 120 may be an elastic material that is stiff in its plane and relatively flexible in bending. The reflector material may be thin enough to bend to a radius of a few inches without permanent deformation.

Figure 5A:
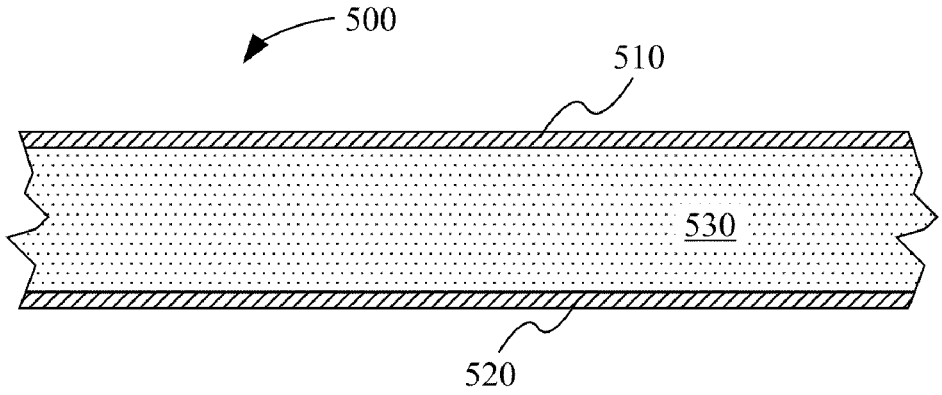
FIG. 5A shows a cross section of a shape-memory stiffener according to one embodiment.

Shape-memory reflector 100 shown in FIG. 1 may be deployed in an off-axis paraboloid shape. Shape-memory reflector 100 includes a plurality of panel shape-memory stiffeners 110 and a plurality of longitudinal stiffeners 130. Panel shape-memory stiffeners 110 may comprise any shape-memory material described in commonly assigned U.S. patent application Ser. No. 12/033,584, filed 19 Feb. 2008, entitled "Highly Deformable Shape-memory Polymer Core Composite Deformable Sandwich Panel," which is incorporated herein by reference for all purposes. FIG. 5A shows a cross section of an example of shape-memory material that may be used.

In one embodiment, panel shape-memory stiffener 110 comprises a sandwich including a first face sheet, a shape-memory core and a second face sheet. The first and second face sheets may include laminates or layers of composite material. In one embodiment, the reflector material 120 may comprise the first face sheet. The second face sheet may include the same material as the reflector material and may be coupled therewith. The shape-memory core may comprise shape-memory polymer foam. A plurality of panel shape-memory stiffeners may be arrayed along reflective surface 120 and coupled thereto.

Figure 4A:
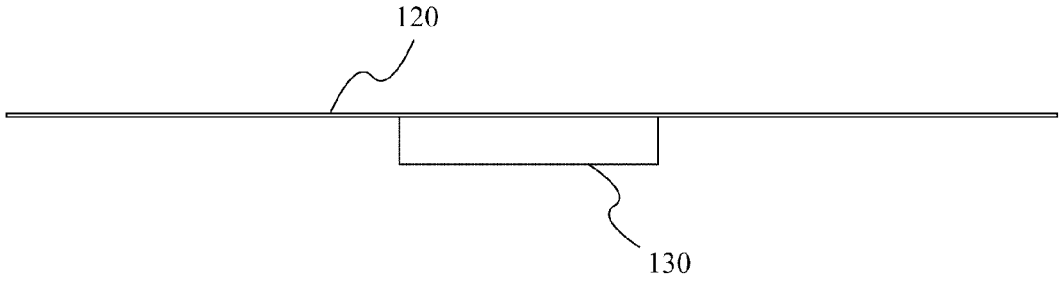
FIG. 4A shows a cross-section of a panel stiffener according to one embodiment.

Longitudinal stiffeners 130 may be arrayed along a surface of the reflective surface 120. Longitudinal stiffeners 130, for example, may be arrayed substantially equidistant from each other along the reflective surfaces. Longitudinal stiffeners 130 may also comprise a thick layer of solid material, such as a thick layer of the same material as the reflector material 120. Longitudinal stiffeners 130 may also comprise plies of graphite composite laminate co-cured with the reflector material 120 during fabrication, or the longitudinal stiffeners 130 may also comprise a strip of composite or other material secondarily bonded to the reflector material 120. The cross section of the radial stiffener may be rectangular, as shown in FIG. 4A, or any other shape, for example, a trapezoid formed by stacking narrower plies of composite on a wider base.

In one embodiment, longitudinal stiffeners 130 may be continuous, flexible, non-collapsible sections. The longitudinal stiffeners 130 may provide sufficient stiffness and dimensional stability in the deployed state so as to maintain the shape of the reflective surface 110. Longitudinal stiffeners 130 may also include sufficient flexibility in bending to enable them to be straightened during packaging. The longitudinal stiffeners may also have sufficient strength longitudinally to react to radial tensile loads in the reflective surface that are applied during packaging. Furthermore, the longitudinal stiffeners 130 may have sufficient local strength to provide mounting locations for launch support structures and packaging loads. In some embodiments, longitudinal stiffeners 130 may be arrayed substantially perpendicular to the panel shape-memory stiffeners 110 along reflective surface 120. In some embodiments, longitudinal stiffeners 130 may be arrayed in a non-perpendicular arrangement.

Figure 2A:
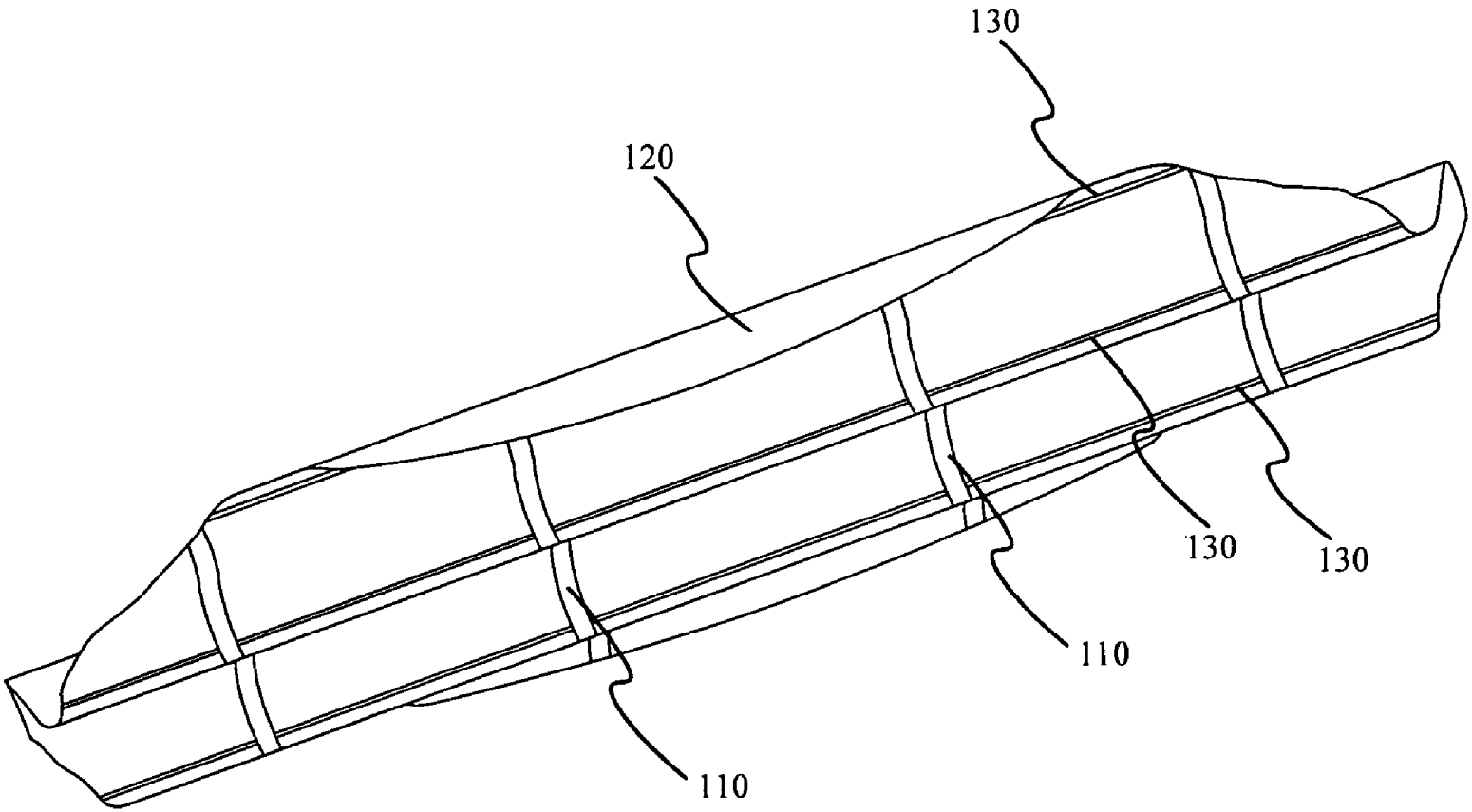
FIG. 2A shows a perspective view of a furlable shape-memory reflector in a stowed configuration according to one embodiment.
Figure 2B:
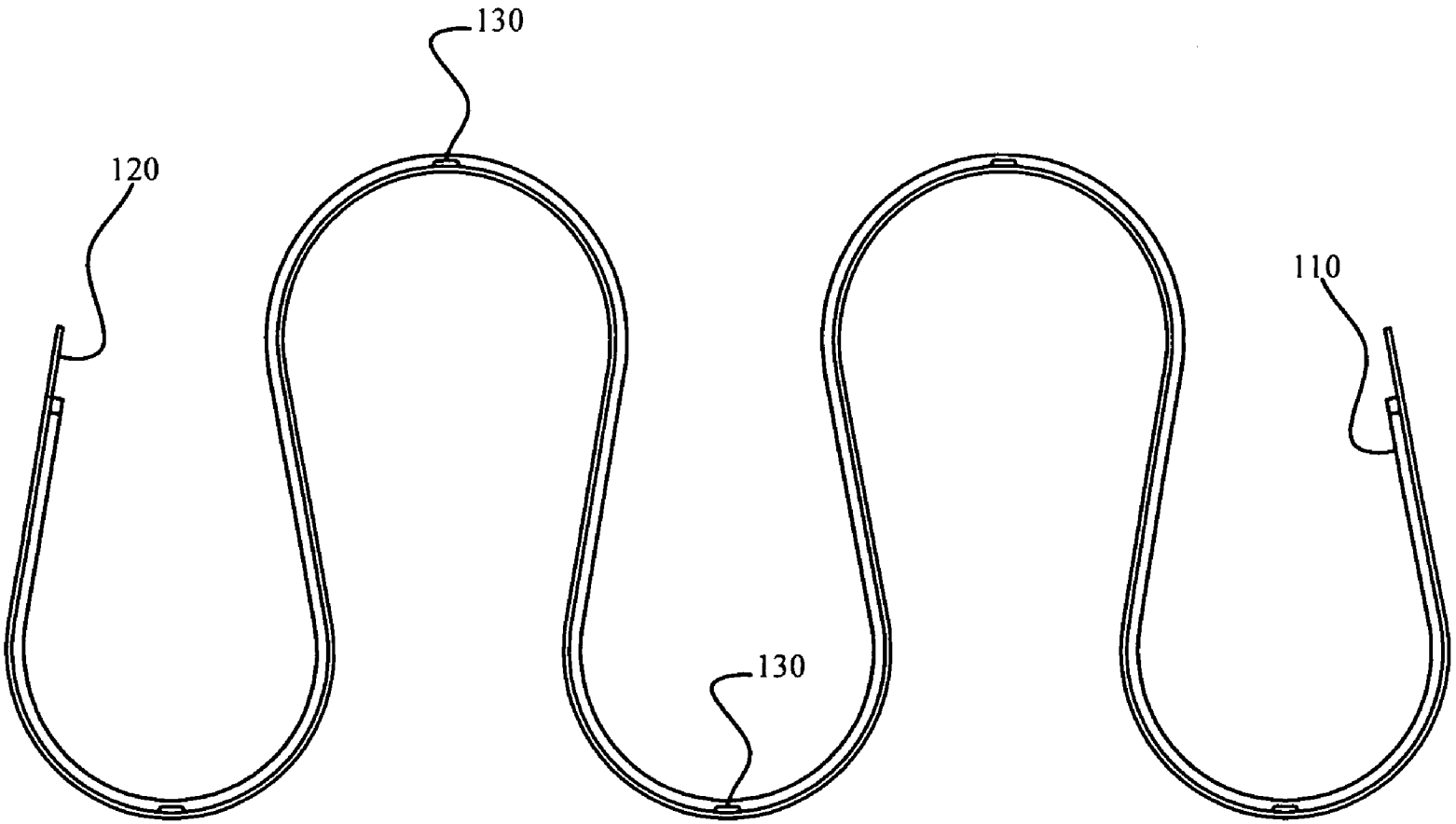
FIG. 2B shows an end view of a furlable shape-memory reflector in a stowed configuration according to one embodiment.

FIG. 2A shows a perspective view of a shape-memory reflector 100 in the stowed configuration according to some embodiments. FIG. 2B shows a end view of a shape-memory reflector 100 in the stowed configuration according to some embodiments. The shape-memory reflector 100, shown in FIGS. 2A and 2B, has five bends. These bends may also be formed within the panel shape-memory stiffeners 110 and the reflective surface 120 as shown. The bends (or pleats), in some embodiments, may also occur along the longitudinal stiffeners 130 of the shape-memory reflector 100. Longitudinal stiffeners 130 may be positioned at the apex of the bends.

Figure 3A:
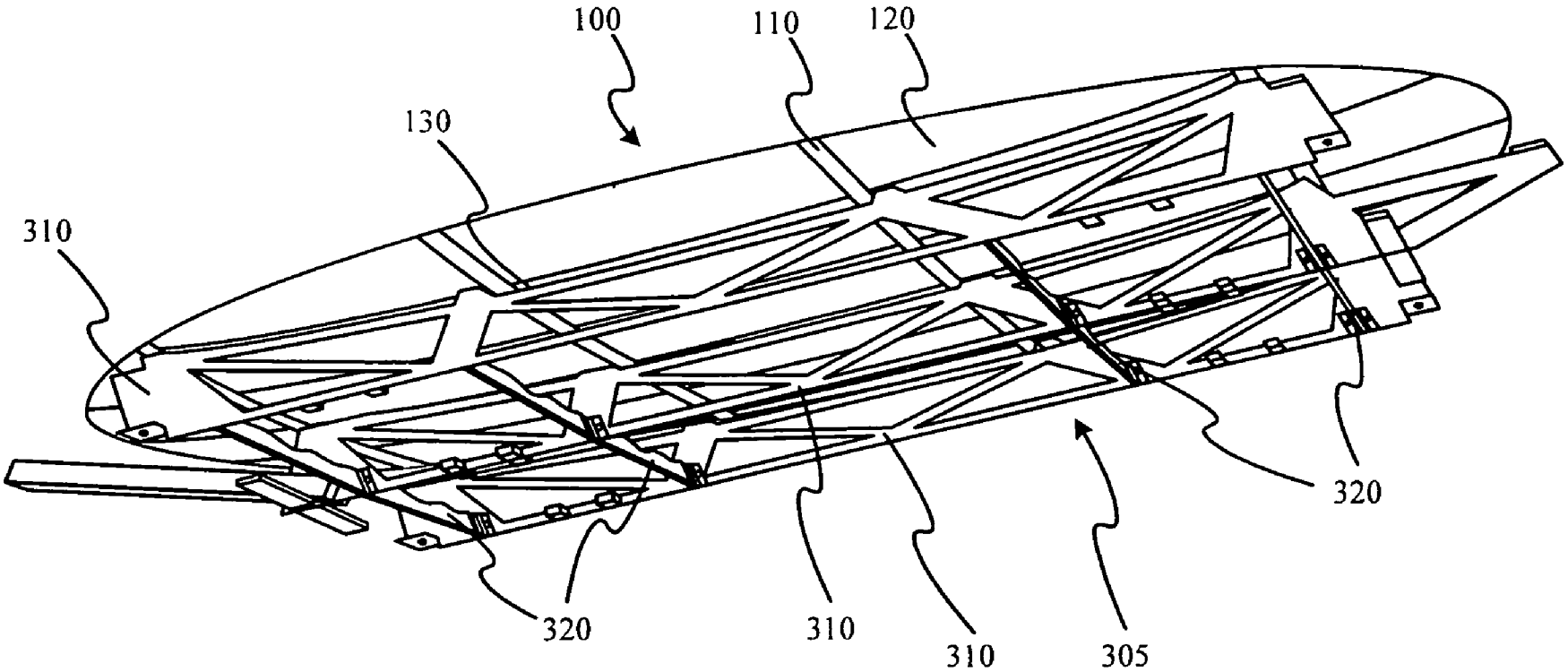
FIG. 3A shows a furlable shape-memory reflector in a deployed configuration along with backing structures according to one embodiment.
Figure 3B:
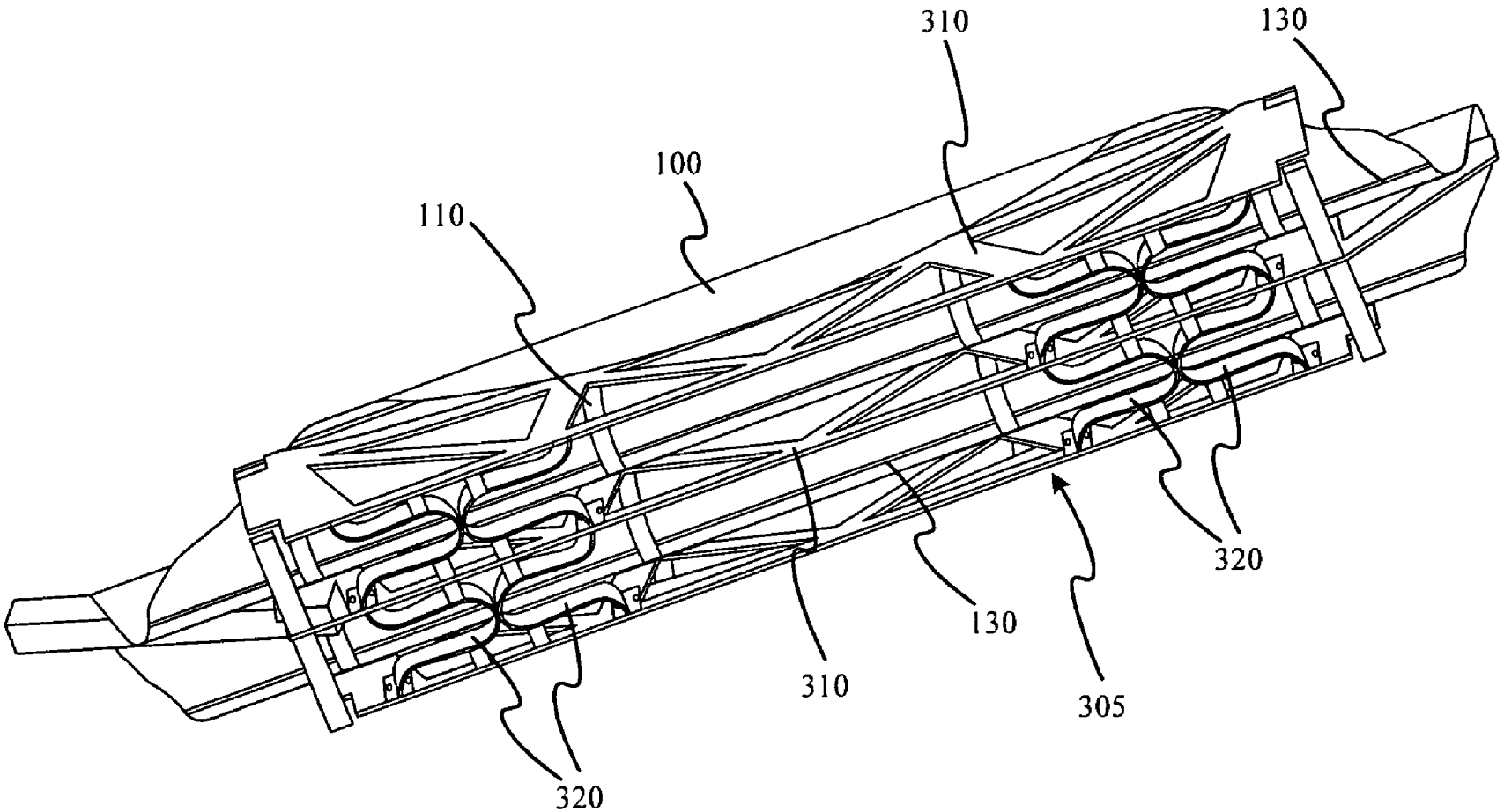
FIG. 3B shows a furlable shape-memory reflector in a stowed configuration along with backing structures according to one embodiment.

In some embodiments, shape-memory reflector 100 is coupled with a backing structure. FIG. 3A shows a furlable shape-memory reflector 100 in a deployed configuration along with backing structure 305 according to one embodiment. FIG. 3B shows a furlable shape-memory reflector 100 in a stowed configuration along with backing structure 305 according to one embodiment. The backing structure may include a series of rigid beams 310. Rigid beams 310 may be substantially parallel with longitudinal stiffeners 130. In some embodiments, rigid beams 310 may be coupled with longitudinal stiffeners 130. In some embodiments, rigid beams 310 may be coupled with alternating longitudinal stiffeners 130. Collapsible stiffeners 320 may span between rigid beams 310. The backing structure 305 may provide deployed stiffness and/or dimensional accuracy. Moreover, the reflector may be attached to, and supported by, the backing structure 305. Backing structure 305 may include a number of radial arms that pivot inward for packaging and deployable truss elements to lock the arms into the deployed position. As shown in FIG. 3A and FIG. 3B, the backing structure may collapse for stowage and expand during deployment, according to some embodiments.

FIG. 4A shows a cross section of a longitudinal stiffener 130 coupled with reflector material 120 according to one embodiment. The cross section of longitudinal stiffener 130 may be rectangular, as shown, or any other shape, for example, a trapezoid formed by stacking narrower plies of composite on a wider base. In other embodiments, longitudinal stiffener 130 may have a semi-circular, semi-oval, concave and/or convex cross section shape.

Figure 4B:
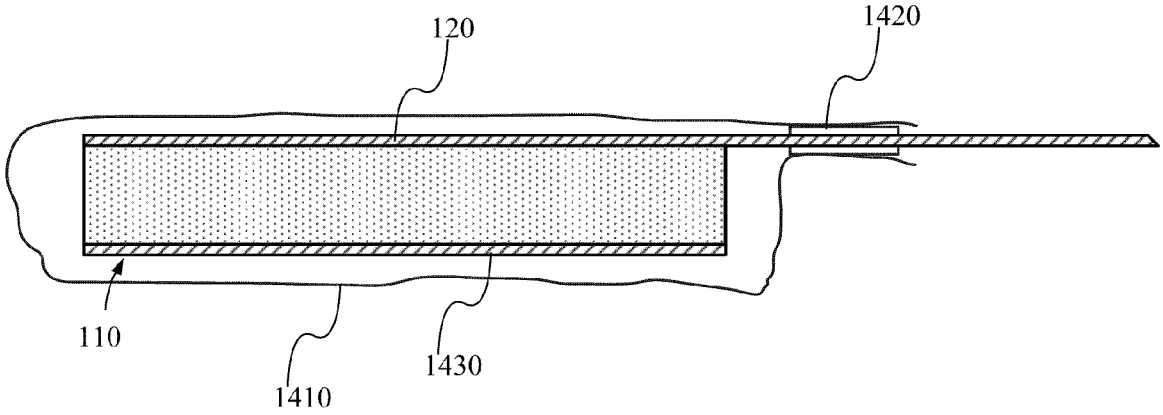
FIG. 4B shows a cut-away view of a panel shape-memory stiffener coupled with an elastic reflector material according to one embodiment.

FIG. 4B shows a cut away view of panel shape-memory stiffener 110 coupled with an outer edge reflector material 120 according to one embodiment. Panel shape-memory stiffener 110 may be enclosed, for example, within a protective covering 1410, such as, for example, multi-layer insulation (MLI). Protective covering 1410 may be coupled with reflector material 120 using any of various adhesives 1420. Note that, in such embodiments, shape-memory stiffener 110 may be coupled with the elastic reflector material 120. Reflector material 120, in some embodiments, comprises one of the face sheets of the shape-memory stiffener 110. Elastic material 1430 comprises the second face sheet of shape memory stiffener 110 and may, in some embodiments, be of the same composition as reflector material 120.

FIG. 5A shows a cross section of a portion of panel shape-memory stiffener 500 according to one embodiment. In one embodiment, panel shape-memory stiffener 500 may be fabricated in various shapes as a panel shape-memory stiffener 110 and attached to the convex surface of the reflector shown in FIG. 1 according to one embodiment. In another embodiment, the panel shape-memory stiffener 500 may also be fabricated with a plurality of discrete shape-memory cores 530 or with discrete pieces of shape-memory core 530 coupled together into a panel shape-memory stiffener 110. Panel shape-memory stiffener 500 may include a first face sheet 510, a second face sheet 520 and a shape-memory core 530. In some embodiments, first and/or second face sheets 510, 520 may comprise the same material or, in other embodiments, first and/or second face sheets 510, 520 may comprise material similar to reflector material 120. Shape-memory core 530 may be in substantially continuous contact with both the first face sheet 510 and the second face sheet 520. That is, the core, in some embodiments, may not be segmented, but instead is in mostly continuous contact with the surface of both face sheets. In other embodiments, the shape-memory core 530 may be in continuous contact with about 75%, 80%, 85%, 90%, 95% or 100% of either and/or both first face sheet 510 and/or second face sheet 520. In some embodiments, however, core 530 may comprise a plurality of discrete shape-memory cores coupled together. Each such discrete core may be coupled with first face sheet 510 and/or second face sheet 520.

First face sheet and/or second face sheet 510, 520 may comprise a thin metallic material according to one embodiment. In other embodiments, first face sheet and/or second face sheet 510, 520 may include fiber-reinforced materials. First face sheet and/or second face sheet 510, 520 may comprise a composite or metallic material. First face sheet and/or second face sheet 510, 520 may also be thermally conductive. The shape-memory core 530 may comprise a shape-memory polymer and/or epoxy, for example, a thermoset epoxy. Shape-memory core 530 may also include either a closed or open cell foam core. Shape-memory core 530 may be a polymer foam with a $T_g$ lower than the survival temperature of the material. For example, the shape-memory core may comprise TEMBO® shape-memory polymers, TEMBO® foams or TEMBO® elastic memory composites.

Figure 5B:
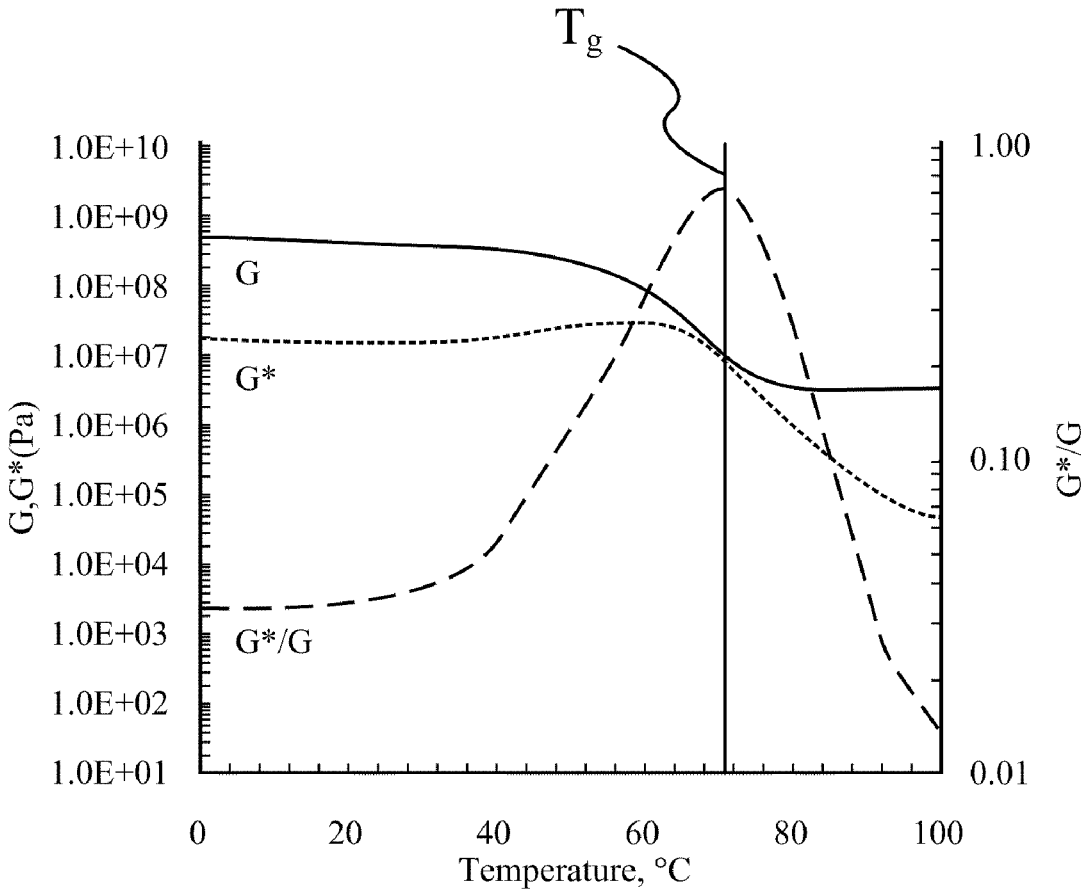
FIG. 5B shows a graph of the shear modulus G, the complex shear modulus G*, and the ratio of the shear modulus to the complex shear modulus G*/G of an exemplary shape-memory material according to one embodiment.

FIG. 5B shows a graph of the shear modulus G, the complex shear modulus G*, and the ratio of the shear modulus to the complex shear modulus G*/G of an exemplary shape-memory material according to one embodiment. The peak in the G*/G curve is defined as the glass transition temperature ($T_g$) of the shape-memory material. Above $T_g$, glasses and organic polymers become soft and capable of plastic deformation without fracture. Below $T_g$, the joining bonds within the material are either intact, or when cooling increase as the material cools. Thus, below $T_g$, materials often become stiff, brittle and/or strong.

Panel shape-memory stiffeners may be a continuous shape-memory sandwich as described above. Panel shape-memory stiffeners may also include a plurality of shape-memory elements coupled together on the surface of the reflector element. Panel shape-memory stiffeners may be collapsible, yet strong and stiff shape-memory polymer based stiffener. Panel shape-memory stiffeners may have sufficient stiffness and dimensional stability in the deployed state (at temperatures below $T_g$) so as to maintain the paraboloid shape of the reflective surface. Moreover, panel shape-memory stiffeners may have sufficient strain and strain energy storage capability at temperatures above $T_g$ to allow packaging the reflector without damage to the reflective surface. Panel shape-memory stiffeners may also include sufficient stiffness and dimensional stability in the packaged state, at temperatures below $T_g$, so as to maintain the packaged shape of the reflector without extensive launch locks. Also, panel shape-memory stiffeners may include sufficient dampening during actuation at temperatures above $T_g$ to effectively control un-furling of the reflective surface.

Figure 6:
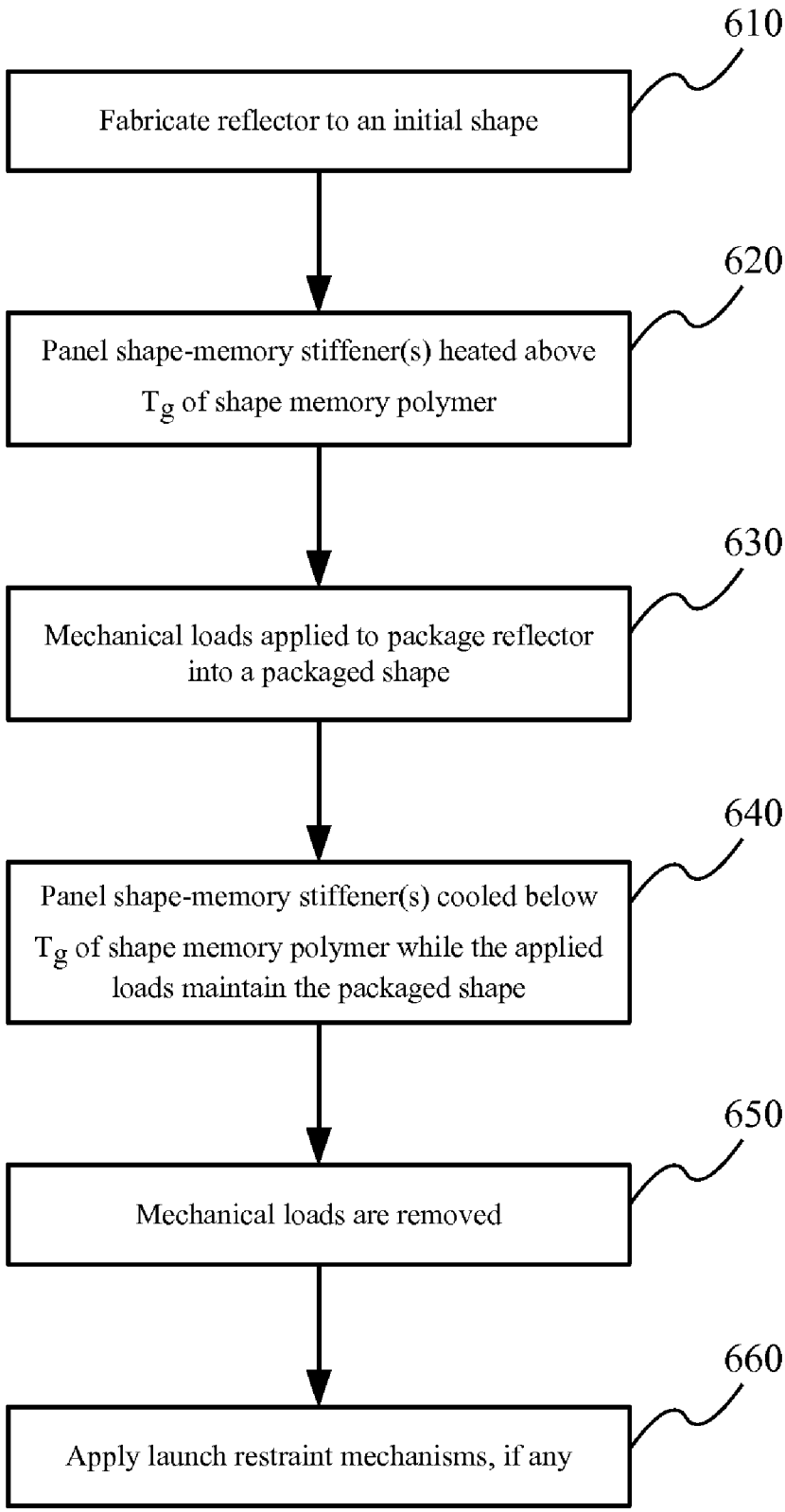
FIG. 6 shows a flowchart of a method for packaging a shape-memory reflector according to one embodiment.

FIG. 6 shows a flowchart of a method for packaging a shape-memory reflector according to one embodiment. At block 610, the reflector is fabricated with an initial deployed shape. The reflector may also be fabricated with panel shape-memory stiffeners and/or longitudinal stiffeners. This deployed configuration may provide a minimum strain energy shape for the reflector. At block 620, the panel shape-memory stiffeners are heated to a temperature above $T_g$ of the shape-memory polymer within the panel shape-memory stiffener. At block 630, mechanical loads are applied to deform reflector into a packaged shape, such as, for example, the packaged shape shown in FIGS. 2A and 2B. At block 640 the panel shape-memory stiffeners are cooled to a temperature below $T_g$ of the shape-memory polymer while the packaged shape is maintained with the applied loads; following which, at block 650, the mechanical loads are removed and the panel shape-memory stiffeners maintain their packaged shape due to strain energy storage in the cooled shape-memory polymer core. The reflector will remain in its packaged condition with minimal or no external loads until deployment. The pleats are stabilized for launch loading by bending stiffness of the packaged shape memory stiffener 110. In some applications, launch restraint mechanisms may be applied at block 660.

Figure 7:
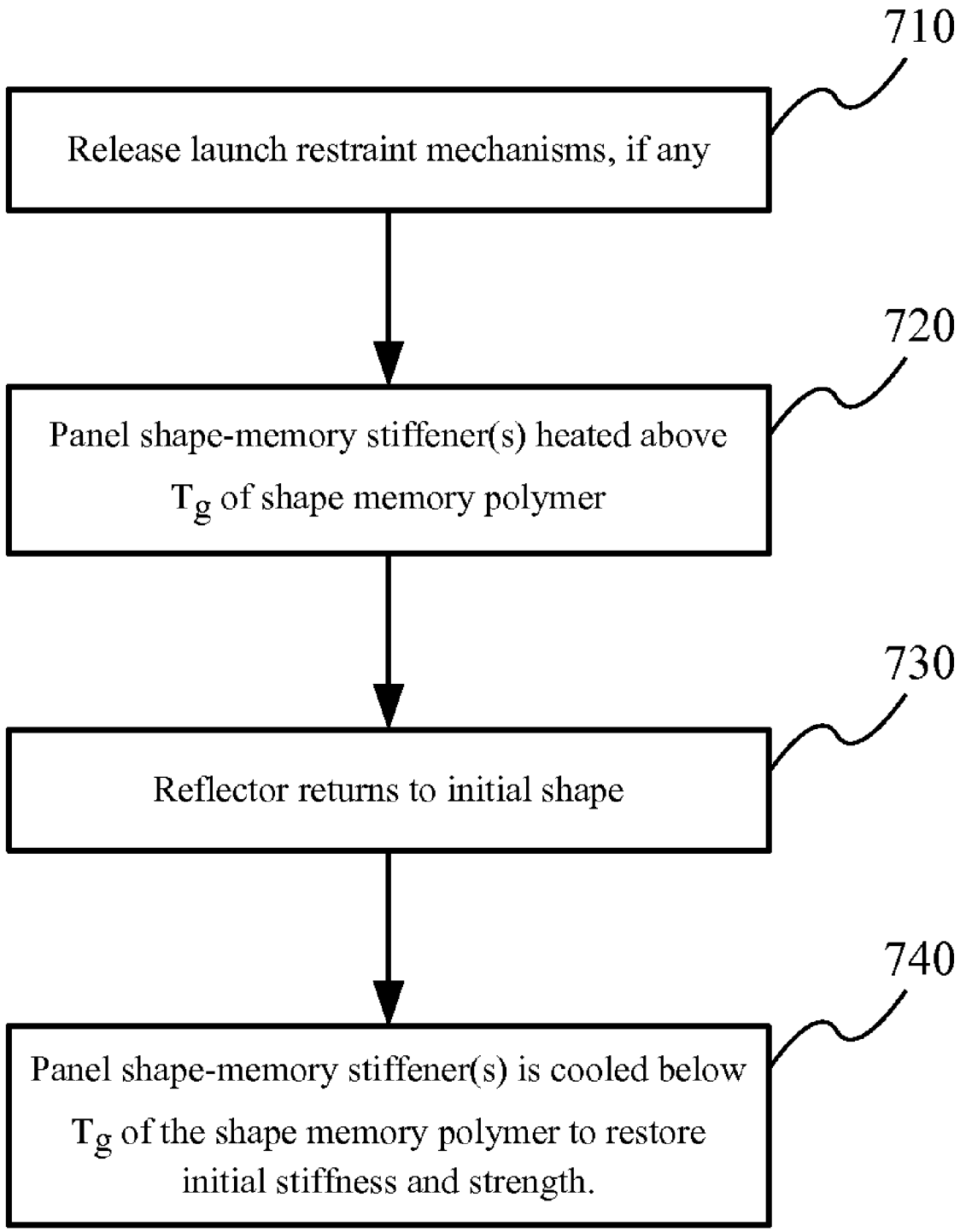
FIG. 7 shows a flowchart of a method for deploying a shape-memory reflector according to one embodiment.

FIG. 7 shows a flowchart of a method for deploying a shape-memory reflector according to one embodiment. At block 710, launch restraints, if any, are released. The panel shape-memory stiffeners may then be heated to a temperature above $T_g$ of the shape-memory polymer within the panel shape-memory stiffeners at block 720. During this heating, the panel shape-memory stiffeners straighten out of reversing bends, allowing the reflector to return to its initial shape with minimal or no external mechanical loads at block 730. At block 740, the shape-memory stiffeners are cooled to a temperature below $T_g$ of the shape-memory polymer. The initial stiffness and/or strength of the shape-memory polymer may be restored upon cooling.

While the principles of the disclosure have been described above in connection with specific apparatuses and methods, this description is made only by way of example and not as limitation on the scope of the disclosure.

What is claimed is:

1. A shape-memory reflector configured to maintain both a first stowed configuration and a deployed configuration, the shape-memory reflector comprising:

a reflector surface comprising a non-shape memory material; and a plurality of noncircular shape-memory stiffeners having a first end and a second end and substantially parallel with each other, wherein the plurality of shape-memory stiffeners are coupled with the reflector surface and the plurality of shape-memory stiffeners extend from the first end to the second end across a portion of the reflector surface, wherein the shape-memory stiffeners comprise a shape memory polymer; and wherein in the deployed configuration the plurality of shape-memory stiffeners are unpleated and the reflector surface defines a deployed three dimensional geometry;

wherein in the stowed configuration the plurality of shape-memory stiffeners are pleated into a first plurality of pleats, and the reflector surface is pleated into a second plurality of pleats; and wherein when one or more of the shape-memory stiffeners in the stowed configuration are heated to a temperature greater than a glass transition temperature of the shape-memory material the shape memory stiffeners actuate the reflector surface into the deployed configuration.

2. The shape-memory reflector according to claim 1, wherein the deployed three dimensional geometry of the reflector surface comprises a non-axially symmetric geometry.

3. The shape-memory reflector according to claim 1, wherein the deployed three dimensional geometry of the reflector surface comprises an off axis paraboloid.

4. The shape-memory reflector according to claim 1, including a subset of the plurality of shape-memory stiffeners arranged substantially parallel to one another.

5. The shape-memory reflector according to claim 1, further comprising a plurality of linear stiffeners coupled with the reflector surface.

6. The shape-memory reflector according to claim 5, including a subset of the plurality of linear stiffeners arranged substantially parallel to one another.

7. The shape-memory reflector according to claim 5, including a subset of the plurality of linear stiffeners arranged perpendicular to a subset of the plurality of shape-memory stiffeners.

8. The shape-memory reflector according to claim 5, wherein the plurality of linear stiffeners comprise a laminate material.

9. The shape-memory reflector according to claim 5, wherein the plurality of linear stiffeners comprise a solid material.

10. The shape-memory reflector according to claim 1, wherein the reflector surface includes a graphite composite laminate.

11. The shape-memory reflector according to claim 1, wherein the shape-memory stiffener comprises a shape-memory polymer having a glass transition temperature that is less than a survival temperature of the shape-memory polymer.

12. The shape-memory reflector according to claim 1, wherein the shape-memory stiffener comprises a composite panel including a first face sheet of elastic material, a second face sheet of elastic material, and a shape-memory polymer core sandwiched between the first face sheet and the second face sheet, wherein the first face sheet includes a portion of the reflector surface.

13. The shape-memory reflector according to claim 1, further comprising heaters coupled with the plurality of shape-memory stiffeners.

14. A method for stowing a shape-memory reflector, the method comprising:

fabricating a shape-memory reflector in a deployed configuration, wherein the shape-memory reflector includes a reflector surface, and a plurality of noncircular shape-memory stiffeners coupled with the reflector surface and substantially parallel with each other, wherein the shape-memory stiffeners comprise a shape-memory material and the reflector surface comprises a non-shape-memory material, wherein the plurality of shape-memory stiffeners have a first end and a second end and extend from the first end to the second end across a portion of the reflector surface;

heating the plurality of shape-memory stiffeners to a temperature above the glass transition temperature of the shape-memory material;

applying mechanical loads to deform the shape-memory stiffeners and the reflector surface into a stowed configuration;

cooling the plurality of shape-memory stiffeners to a temperature below the glass transition temperature of the shape-memory material; and removing the mechanical loads.

15. The method according to claim 14, coupling heaters with the plurality of shape-memory stiffeners.

16. The method according to claim 14, wherein the applying mechanical loads further comprises pleating the plurality of shape-memory stiffeners.

17. The method according to claim 14, wherein the deployed configuration comprises a non-axially symmetric geometry.

18. The method according to claim 14, wherein the deployed configuration comprises an off-axis paraboloid.

19. The method according to claim 14, wherein the fabricating further comprises fabricating at least a subset of the plurality of shape-memory stiffeners parallel to one another.

20. The method according to claim 14, wherein the applying mechanical loads further comprises curving a plurality of linear stiffeners coupled with the reflector surface into reversing bends.

21. The method according to claim 14, wherein the fabricating further comprises coupling a plurality of linear stiffeners with the reflector surface parallel to one another.

22. The method according to claim 14, wherein the fabricating further comprises coupling a plurality of linear stiffeners with the reflective surface perpendicular to at least a subset of the plurality of shape-memory stiffeners.

23. A method for deploying a shape-memory reflector from a stowed configuration, wherein the shape-memory reflector includes a reflector surface comprising non-shape-memory material, and a plurality of noncircular shape-memory stiffeners comprising shape-memory material and substantially parallel with each other coupled with the reflector surface and the plurality of shape-memory stiffeners include a first end and a second end, wherein in the stowed configuration the plurality of shape-memory stiffeners are pleated into a plurality of pleats, and the reflector surface is pleated into a plurality of pleats, the method comprising:

heating the plurality of shape-memory stiffeners to a temperature above the glass transition temperature of the shape-memory material;

actuating the reflector surface into the non-pleated configuration using the shape-memory stiffeners, wherein in the non-pleated configuration the plurality of shape-memory stiffeners extend across a portion of the reflector surface from the first end to the second end; and cooling the plurality of shape-memory stiffeners to a temperature below the glass transition temperature of the shape-memory material.

24. The method according to claim 23, further comprising releasing launch restraints.

25. The method according to claim 23, wherein a subset of the plurality of shape-memory stiffeners are straightened parallel to one another.

26. The method according to claim 23, further comprising releasing one or more linear stiffeners coupled with the reflector surface from reversing bends.

27. The method according to claim 23, wherein a subset of the plurality of shape-memory stiffeners are straightened in a configuration perpendicular to one or more linear stiffeners coupled with the reflector surface.

* * * * *